US009472328B2

(12) United States Patent
Hosokawa et al.

(10) Patent No.: US 9,472,328 B2
(45) Date of Patent: Oct. 18, 2016

(54) IRON-BASED SOFT MAGNETIC POWDER FOR DUST CORE USE, MANUFACTURING METHOD THEREOF, AND DUST CORE

(75) Inventors: Mamoru Hosokawa, Kobe (JP); Wataru Urushihara, Kobe (JP); Takeshi Ohwaki, Kobe (JP); Tomotsuna Kamijo, Takasago (JP); Hirofumi Hojo, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 399 days.

(21) Appl. No.: 14/124,866

(22) PCT Filed: Jun. 15, 2012

(86) PCT No.: PCT/JP2012/065401

§ 371 (c)(1),
(2), (4) Date: Feb. 21, 2014

(87) PCT Pub. No.: WO2012/173239

PCT Pub. Date: Dec. 20, 2012

(65) Prior Publication Data

US 2014/0183402 A1 Jul. 3, 2014

(30) Foreign Application Priority Data

Jun. 17, 2011 (JP) ..... 2011-135670
Mar. 14, 2012 (JP) ..... 2012-057933

(51) Int. Cl.
*B22F 1/02* (2006.01)
*B22F 3/02* (2006.01)
(Continued)

(52) U.S. Cl.
CPC ..... *H01F 1/20* (2013.01); *C22C 33/02* (2013.01); *H01F 1/24* (2013.01); *H01F 41/02* (2013.01);
(Continued)

(58) Field of Classification Search
CPC ..... B22F 1/02; B22F 3/02; B22F 2998/10; C22C 3/02; H01F 1/20; H01F 1/24; H01F 1/26; H01F 27/255; H01F 41/02; H01F 41/0246
USPC ..... 148/104; 252/62.54, 62.55; 427/127
See application file for complete search history.

(56) References Cited

U.S. PATENT DOCUMENTS 1,850,181 A 3/1932 Roseby
5,063,011 A * 11/1991 Rutz ..... H01F 1/24 148/105
(Continued)

FOREIGN PATENT DOCUMENTS

CN 1910706 A 2/2007
CN 101479062 A 7/2009
(Continued)

OTHER PUBLICATIONS

English translation of JP 02/070003; Mar. 1990; 7 pages.*
(Continued)

*Primary Examiner* — Helene Klemanski
(74) *Attorney, Agent, or Firm* — Oblon, McClelland, Maier & Neustadt, L.L.P.

(57) ABSTRACT

Disclosed is an iron-based soft magnetic powder for dust core use, which includes an iron-based soft magnetic matrix powder and a phosphate conversion coating on a surface of the matrix powder. The phosphate conversion coating contains nickel element and has an aluminum content of equal to or less than that in the matrix powder. The iron-based soft magnetic powder has such excellent heat resistance as to maintain electrical insulation at satisfactory level even after subjected to a high-temperature heat treatment.

18 Claims, 2 Drawing Sheets

(51) Int. Cl.

| | |
|---|---|
| ***C22C 33/02*** | (2006.01) |
| ***H01F 1/20*** | (2006.01) |
| ***H01F 1/24*** | (2006.01) |
| ***H01F 1/26*** | (2006.01) |
| ***H01F 27/255*** | (2006.01) |
| ***H01F 41/02*** | (2006.01) |

(52) U.S. Cl.
CPC ..... *H01F 41/0246* (2013.01); *B22F 2998/10* (2013.01); *H01F 1/26* (2013.01); *H01F 27/255* (2013.01)

(56) References Cited

U.S. PATENT DOCUMENTS

| | | | | |
|---|---|---|---|---|
| 5,754,936 | A | 5/1998 | Jansson | |
| 5,904,786 | A | 5/1999 | Wendel et al. | |
| 5,982,073 | A * | 11/1999 | Lashmore | B22F 1/02 310/156.38 |
| 6,042,949 | A | 3/2000 | Lashmore | |
| 6,544,352 | B2 | 4/2003 | Mitani et al. | |
| 6,749,767 | B2 | 6/2004 | Mitani et al. | |
| 6,940,388 | B2 * | 9/2005 | Moro | H01F 41/0246 148/104 |
| 7,235,208 | B2 * | 6/2007 | Moro | H01F 41/0246 148/104 |
| 8,236,087 | B2 | 8/2012 | Mitani et al. | |
| 8,323,422 | B2 | 12/2012 | Ohwaki et al. | |
| 8,409,707 | B2 | 4/2013 | Mitani et al. | |
| 8,445,105 | B2 | 5/2013 | Mitani et al. | |
| 2003/0077448 | A1 * | 4/2003 | Ueta | H01F 1/24 428/403 |
| 2004/0126609 | A1 * | 7/2004 | Ueta | B22F 1/02 428/570 |
| 2004/0191519 | A1 | 9/2004 | Kejzelman et al. | |
| 2006/0159960 | A1 | 7/2006 | Maeda et al. | |
| 2008/0248245 | A1 | 10/2008 | Maeda et al. | |
| 2009/0242825 | A1 | 10/2009 | Ohwaki et al. | |
| 2010/0051851 | A1 | 3/2010 | Mitani et al. | |
| 2010/0212455 | A1 | 8/2010 | Ohwaki et al. | |
| 2011/0227690 | A1 * | 9/2011 | Watanabe | H01F 1/26 336/221 |
| 2012/0164453 | A1 | 6/2012 | Hojo et al. | |
| 2012/0286909 | A1 | 11/2012 | Ohwaki et al. | |
| 2013/0181804 | A1 | 7/2013 | Miyamura et al. | |
| 2014/0002219 | A1 * | 1/2014 | Mitani | H01F 1/26 252/62.54 |
| 2015/0187493 | A1 * | 7/2015 | Mitani | H01F 1/24 419/62 |
| 2015/0228387 | A1 * | 8/2015 | Urushihara | |

FOREIGN PATENT DOCUMENTS

| | | | |
|---|---|---|---|
| EP | 1 912 225 | A1 | 4/2008 |
| JP | 2 70003 | | 3/1990 |
| JP | 10-510322 | A | 10/1998 |
| JP | 2002 83709 | | 3/2002 |
| JP | 2003 303711 | | 10/2003 |
| JP | 2004 143554 | | 5/2004 |
| JP | 2008 63651 | | 3/2008 |
| JP | 2010 56419 | | 3/2010 |
| JP | 2001 85211 | | 3/2011 |
| JP | 2011 114331 | | 6/2011 |
| KR | 10-0267836 | B1 | 10/2000 |
| WO | WO 96/02345 | A1 | 2/1996 |

OTHER PUBLICATIONS

U.S. Appl. No. 14/004,432, filed Sep. 11, 2013, Mitani, et al.
Written Opinion of the International Searching Authority Issued Sep. 18, 2012 in PCT/JP12/65401 Filed Jun. 15, 2012.
International Search Report Issued Sep. 18, 2012 in PCT/JP12/65401 Filed Jun. 15, 2012.
Extended European Search Report issued Feb. 5, 2015 in Patent Application No. 12799858.1.

* cited by examiner

IRON-BASED SOFT MAGNETIC POWDER FOR DUST CORE USE, MANUFACTURING METHOD THEREOF, AND DUST CORE

TECHNICAL FIELD

The present invention relates to an iron-based soft magnetic powder for dust core use, which includes a soft magnetic matrix powder such as an iron powder or an iron-based alloy powder (hereinafter the both are synthetically simply referred to as an "iron matrix powder") and, lying on a surface thereof a highly thermally stable insulating coating. The iron-based soft magnetic powder for dust core use, when compacted, gives a dust core that is usable as a magnetic core for electromagnetic parts. The dust core according to the present invention excels in properties such as mechanical strength and particularly in electrical resistivity at high temperatures.

BACKGROUND ART

Magnetic cores for use in alternating magnetic fields should have a low core loss and a high magnetic flux density. They should also have satisfactory handleability and be resistant to breakage upon coiling during manufacturing processes. To meet these requirements, a technique of coating iron powdery particles with a resin is known in dust core technologies. The resulting electrically-insulating resin coating suppresses the eddy-current loss and helps the magnetic core to have a higher mechanical strength because the resin bonds the iron powdery particles with each other.

Dust cores are more and more employed as motor cores recently. This is because as follows. Customary motor cores employ laminates typically of magnetic steel sheets or electrical core sheets. By contrast, the dust cores are manufactured by compacting, thereby have high degree of freedom in shape, can be easily formed even into three-dimensionally-shaped cores, and give motors having a smaller size and a lighter weight than those of motors using the customary materials. Such dust cores for use as motor cores require a higher magnetic flux density, a lower core loss, and a higher mechanical strength more than ever.

It is believed that formation of a high-density powder compact is effective for improving the magnetic flux density; and that a heat treatment (annealing) of the powder compact at a high temperature to relieve the strain of the powder compact is effective for reducing core loss represented by hysteresis loss. Demands have therefore been made to develop an iron powder for dust core use as follows. The iron powder can effectively insulate iron powdery particles from each other even when an insulating material is used in a smaller amount so as to give a high-density powder compact. In addition, the iron powder can maintain good electrical insulation even after subjected to a high-temperature heat treatment such as annealing.

As a possible solution to this, there has been developed a technique of using a heat-resistant silicone resin as an insulating material. Typically, a technique disclosed in PTL 1 employs a specific methyl-phenylsilicone resin as an insulating material. This technique, however, uses the resin in an amount of 1 percent by mass or more (relative to the mass of the iron matrix powder) for ensuring satisfactory heat resistance and is susceptible to improvements in high-density compacting. In addition, there are proposed techniques of adding a glass powder or a pigment to a silicone resin so as to ensure heat resistance (e.g., PTL 2 and PTL 3).

However, the addition of a glass powder or pigment disadvantageously impedes high-density compacting.

CITATION LIST

Patent Literature

PTL 1: Japanese Unexamined Patent Application Publication (JP-A) No. 2002-83709
PTL 2: JP-A No. 2004-143554
PTL 3: JP-A No. 2003-303711

SUMMARY OF INVENTION

Technical Problem

In consideration of such problems in the customary techniques by the present inventors, it is an object of the present invention to provide an iron powder for duct core use, which iron powder has such superior thermal stability as to maintain electrical insulation even after a heat treatment at a high temperature.

Solution to Problem

The present invention achieves the object and provides an iron-based soft magnetic powder for dust core use, which includes an iron-based soft magnetic matrix powder; and a phosphate conversion coating present on a surface of the iron-based soft magnetic matrix powder, in which the phosphate conversion coating contains nickel element; and the phosphate conversion coating has an aluminum content of equal to or less than that in the iron-based soft magnetic matrix powder.

When a matrix powder containing no aluminum element is used, the phosphate conversion coating preferably contains no aluminum element. When the phosphate conversion coating contains phosphorus in an amount of $M_P$ (in mol) and nickel in an amount of $M_{Ni}$ (in mol), a ratio of $M_{Ni}$ to $M_P$ ($M_{Ni}/M_p$) is preferably from 0.1 to 0.5. In a preferred embodiment, the phosphate conversion coating further contains potassium element.

In another preferred embodiment, the iron-based soft magnetic powder further includes a silicone resin coating present on the phosphate conversion coating.

The present invention further provides a method for manufacturing an iron-based soft magnetic powder for dust core use. The method includes the steps of mixing an iron-based soft magnetic matrix powder with a phosphoric acid solution containing substantially no aluminum element to give a mixture, the phosphoric acid solution prepared by dissolving a nickel-containing compound and a phosphoric acid in water; and evaporating water from the mixture to give a phosphate-conversion-coated iron powder including the iron-based soft magnetic matrix powder and, formed on a surface thereof a phosphate conversion coating.

In a preferred embodiment, the method further includes, after the step of evaporating, the steps of mixing the phosphate-conversion-coated iron powder with a silicone resin solution to give a mixture, the silicone resin solution prepared by dissolving a silicone resin in an organic solvent; evaporating the organic solvent from the mixture to give a silicone-resin-coated iron powder further including a silicone resin coating on the phosphate conversion coating; and heating the silicone-resin-coated iron powder to precure the silicone resin coating, in this order.

In another preferred embodiment of the present invention, the nickel-containing compound is nickel pyrophosphate and/or nickel nitrate.

In yet another preferred embodiment, the phosphoric acid solution has a nickel ion content of from 0.003 to 0.015 mol per 100 ml of the phosphoric acid solution, which phosphoric acid solution contains no aluminum element and is prepared by dissolving a nickel-containing compound and a phosphoric acid in water. In another preferred embodiment, this phosphoric acid solution further contains potassium element.

The present invention also includes a dust core which is obtained by compacting an iron-based soft magnetic powder for dust core use to give a powder compact, where the iron-based soft magnetic powder is manufactured by the manufacturing method; and subjecting the powder compact to a heat treatment at a temperature of 500° C. or higher.

Advantageous Effects of Invention

The iron-based soft magnetic powder for dust core use according to the present invention can have higher heat resistance of the phosphate conversion coating by the presence of added nickel element and can be subjected to a heat treatment at a higher temperature. The iron-based soft magnetic powder thereby gives a dust core with a low core loss.

DESCRIPTION OF EMBODIMENTS

Figure 1:
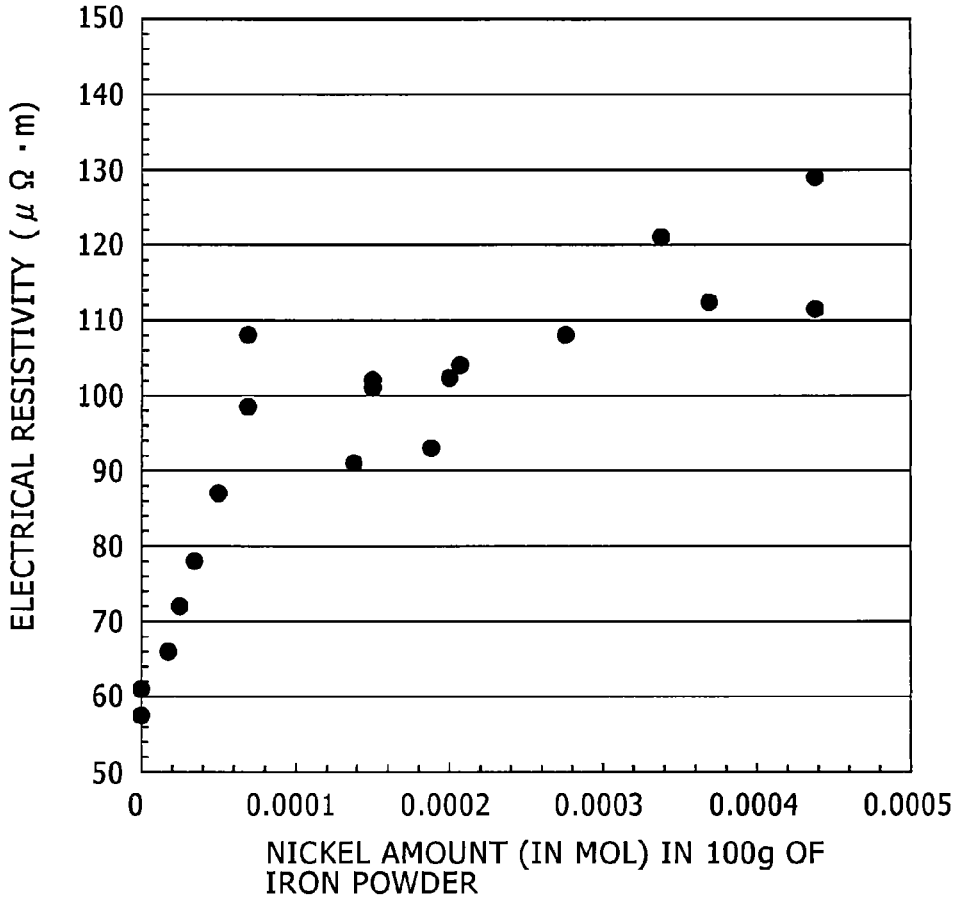
FIG. 1 depicts a graph illustrating how the electrical resistivity varies depending on the nickel amount in mole in 100 g of an iron powder.

An iron-based soft magnetic powder for dust core use according to an embodiment of the present invention includes an iron-based soft magnetic matrix powder and, present on a surface thereof a phosphate conversion coating, in which the phosphate conversion coating contains nickel element; and the phosphate conversion coating has an aluminum content of equal to or less than that in the matrix powder.

The phosphate conversion coating, as containing nickel element, can have better heat resistance (thermal stability). This allows the iron-based soft magnetic powder for dust core use to undergo a heat treatment at a high temperature and to give a dust core having a lower core loss.

The phosphate conversion coating, as containing nickel element, has better heat resistance. Although reasons remain unclear, this is probably because as follows. Specifically, a phosphate conversion coating containing no nickel element readily suffers from unevenness in thickness. The phosphate conversion coating containing no nickel element therefore has extremely thin regions in large numbers as compared to a phosphate conversion coating having the same average thickness but containing nickel element. When an iron-based soft magnetic powder for dust core use having such phosphate conversion coating with uneven thickness is subjected to a heat treatment, the constitutive iron powdery particles readily come in contact with each other in the extremely thin regions as a result of the sintering action of the iron powder accompanied with the heating. Thus, the iron-based soft magnetic powder exhibits inferior insulation at a relatively lower temperature.

In contrast to this, the phosphate conversion coating containing nickel element readily has a uniform thickness and does not suffer from extremely thin regions. The resulting iron-based soft magnetic powder for dust core use having this coating can maintain insulation even after subjected to a heat treatment at a high temperature. This is because the constitutive iron powdery particles hardly come in contact with each other.

In the present invention, the phosphate conversion coating has an aluminum content of equal to or less than the aluminum content in the iron-based soft magnetic matrix powder, which matrix powder acts as a nucleus (matrix) and belongs to a portion of the iron-bad soft magnetic powder other than the phosphate conversion coating (and other coatings). This means that the aluminum content in the matrix powder is not increased by the coating formation treatment (chemical conversion treatment) and that the treatment is performed with a phosphating solution containing substantially no aluminum element. This is because, when a phosphating solution prepared by dissolving a phosphorus-containing compound and a nickel-containing compound in water is used to form a nickel-containing phosphate conversion coating, and if the phosphating solution further contains aluminum element dissolved therein, the phosphating solution may have a lower nickel solubility, and this may impede the preparation of a phosphating solution having a desired nickel content.

The present invention will be illustrated in detail below.

Iron-based Soft Magnetic Matrix Powder

An iron-based soft magnetic matrix powder for use herein is a ferromagnetic iron-based powder and is exemplified by pure iron powder, powders of iron-based alloys (e.g., Fe—Al alloy, Fe—Si alloy, sendust, and Permalloy), and iron-based amorphous powders. These iron-based soft magnetic matrix powders can be manufactured typically by melting iron (or an iron alloy), atomizing the molten iron (or molten iron alloy) into micropartides, reducing the micropartides, and pulverizing the reduced microparticles. This manufacturing process may give an iron-based soft magnetic matrix powder having a particle size (median diameter) of from about 20 μm to about 250 μm. The iron-based soft magnetic matrix powder for use in the present invention preferably has a particle size (median diameter) of from about 50 μm to about 150 μm. The term "particle size (median diameter)" as used herein refers to a particle size at which the cumulative particle size distribution reaches 50% as determined by sieve analysis.

Phosphate Conversion Coating

The iron-based soft magnetic powder according to the present invention includes the soft magnetic matrix powder and, formed thereon, a phosphate conversion coating. The phosphate conversion coating is a coating that can be formed by a chemical conversion treatment with a phosphating solution and is formed as a coating containing iron (Fe) derived from the iron-based soft magnetic matrix powder. The phosphating solution is a solution of a phosphorus-containing compound (e.g., orthophosphoric acid ($H_3PO_4$)). The phosphate conversion coating herein essentially contains nickel element.

When an iron matrix powder containing no nickel is used, the resulting iron powder after the formation of the phosphate conversion coating (phosphate-conversion-coated iron powder) has a nickel content of preferably from 0.001 percent by mass to 0.05 percent by mass, and more preferably from 0.01 percent by mass to 0.03 percent by mass, based on the total amount (100 percent by mass) of the phosphate-conversion-coated iron powder. This range is preferred for effective uniformization of the thickness of the phosphate conversion coating by the addition of nickel element.

When the phosphate conversion coating contains phosphorus in an amount of $M_P$ (in mol) and nickel in an amount of $M_{Ni}$ (in mol), the ratio ($M_{Ni}/M_P$) of the nickel amount to the phosphorus amount is preferably from 0.1 to 0.5. Control of the ratio of $M_{Ni}$ to $M_P$ within this range allows the phosphate conversion coating to have heat resistance at satisfactory level and to have a lower electrical resistivity. The ratio of $M_{Ni}$ to $M_P$ is more preferably from 0.15 to 0.4. The ratio of $M_{Ni}$ to $M_P$ is defined by the molar ratio of the respective elements contained in the phosphate conversion coating. By defining the ratio of $M_{Ni}$ to $M_P$ as a molar ratio, the ratio between the nickel amount and the phosphorus amount in the phosphate conversion coating can be suitably controlled even if the thickness of the phosphate conversion coating varies.

The phosphate conversion coating for use herein may further contain any of other elements such as Na, K, N, S, and Cl. These elements are derived from additives that are added according to necessity to the phosphating solution containing a phosphorus-containing compound so as to control the pH of the phosphating solution or to accelerate the reaction thereof.

Of these elements, the phosphate conversion coating preferably further contains K (potassium element). The presence of the potassium element can inhibit the formation of a semiconductor by combination of O (oxygen) and Fe (iron) contained in the phosphate conversion coating during heat treatment at a high temperature. The inhibition of the semiconductor formation can suppress reduction in electrical resistivity and transverse rupture strength caused by the heat treatment and allows the phosphate conversion coating to have better heat resistance.

The amounts of these elements are each preferably from 0.001 percent by mass to 1.0 percent by mass based on the total amount (100 percent by mass) of the iron powder after the formation of a phosphate conversion coating (phosphate-conversion-coated iron powder). The phosphate conversion coating may further contain any of other metal elements within ranges not adversely affecting advantageous effects of the present invention.

In contrast, the aluminum content of the phosphate conversion coating is minimized. In a preferred embodiment, the phosphate conversion coating contains substantially no aluminum element. This is because, when a phosphating solution containing a phosphorus-containing compound and a nickel-containing compound is used to form a phosphate conversion coating, aluminum element, if present in the phosphating solution, reduces the nickel solubility in the phosphating solution, and this may impede the preparation of a phosphating solution having a desired nickel content. When the material iron matrix powder contains aluminum element, the aluminum element may inevitably migrate into the phosphate conversion coating even when the phosphating solution contains no aluminum element. The phosphate conversion coating can therefore contain a small amount of aluminum element. In this case, the phosphate conversion coating has an aluminum content (in mass percent) of equal to or less than the aluminum content (in mass percent) in the iron matrix powder before the phosphate conversion coating (iron matrix powder without phosphate conversion coating). This means that the iron powder after the formation of phosphate conversion coating (phosphate-conversion-coated iron powder) has an aluminum content, based on the total mass (100 percent by mass) of the phosphate-conversion-coated iron powder, of equal to or less than the aluminum content in the iron matrix powder without phosphate conversion coating. When the iron matrix powder without phosphate conversion coating contains no aluminum element, the phosphate-conversion-coated iron powder preferably has an aluminum content of 0 percent by mass.

The phosphate conversion coating preferably has a thickness of from about 1 nm to about 250 nm. The phosphate conversion coating, if having a thickness of less than 1 nm, may fail to exhibit satisfactory insulation effects. In contrast, the phosphate conversion coating, if having a thickness of more than 250 nm, may exhibit saturated insulation effects and may impede the formation of a higher-density powder compact. The phosphate conversion coating more preferably has a thickness of from 10 nm to 50 nm. The thickness preferably falls within the range of from about 0.01 percent by mass to about 0.8 percent by mass in terms of mass of coating.

Phosphate Conversion Coating Formation Method

The iron-based soft magnetic powder for dust core use according to the present invention can be manufactured by any embodiment. Typically, the iron-based soft magnetic powder can be formed by mixing a solution (phosphating solution) with a soft magnetic powder to give a mixture, and drying the mixture. The phosphating solution is prepared by dissolving a phosphorus-containing compound and a nickel-containing compound in an aqueous solvent.

The compounds for use herein are exemplified by orthophosphoric acid ($H_3PO_4$: phosphorus source), $(NH_2OH)_2.H_2PO_4$ (phosphorus source), nickel pyrophosphate ($Ni_2P_2O_7$: nickel and phosphorus source), nickel nitrate ($Ni(NO_3)_2$: nickel source), nickel sulfate, nickel chloride, and nickel carbonate.

In an embodiment, the phosphating solution can be a phosphoric acid solution which is obtained by dissolving a nickel-containing compound and a phosphoric acid in water and which contains substantially no aluminum element. The phosphoric acid solution may be prepared by dissolving a nickel-containing compound and a phosphoric acid or a compound thereof in water, or by preparing an aqueous nickel-containing compound solution and an aqueous phosphoric acid-containing solution in advance and mixing these solutions.

In a preferred embodiment, the phosphoric acid solution has a nickel ion content of from 0.003 to 0.015 mol per 100 ml of the solution. The phosphoric acid solution according to this embodiment, when used, enables control of the ratio ($M_{Ni}/M_P$) of the nickel amount to the phosphorus amount in the phosphate conversion coating to the range of from 0.1 to 0.5. With an increasing nickel ion content in the phosphoric acid solution, the resulting dust core more effectively has a higher electrical resistivity. However, if a phosphoric acid solution having an excessively high nickel ion content is used to manufacture a dust core, the insulation effect is saturated, and the dust core may be prevented from having a higher density and may thereby have a lower strength The phosphoric acid solution may be prepared by diluting a base agent for phosphoric acid solution with water. The base agent contains substantially no aluminum element and is prepared by dissolving a nickel-containing compound and a phosphoric acid in water so as to give a nickel ion content of from 0.003 to 0.015 mol per 100 ml of the resulting phosphoric acid solution.

The phosphating solution may further contain any of additives for pH control or for reaction acceleration. The additives are exemplified by alkali metal salts such as sodium (Na) salts and potassium (K) salts; ammonia and ammonium salts; sulfates; nitrates; and phosphates (salts of phosphoric acid). The sulfates are exemplified by $(NH_2OH)_2.H_2SO_4$. The phosphates are exemplified by $KH_2PO_4$, $NaH_2PO_4$, and $(NH_2OH)_2.H_2PO_4$. Of these, $KH_2PO_4$ and $NaH_2PO_4$ contribute to pH control of the phosphating solution; whereas $(NH_2OH)_2.H_2SO_4$ and $(NH_2OH)_2.H_2PO_4$ contribute to the acceleration of the phosphating solution reaction. When any of these additives is used, an alkali metal, such as Na or K, derived from the pH controlling agent; and/or P, S, or another element derived from the reaction-accelerating agent is to be contained in the phosphate conversion coating. In particular, potassium, when present in the phosphate conversion coating, can also effectively suppress the semiconductor formation, as mentioned above. In a preferred embodiment, the phosphating solution contains no aluminum-containing compound.

The aqueous solvent for use herein is exemplified by water; hydrophilic organic solvents such as alcohols and ketones; and mixtures of them. The solvent may further contain a known surfactant.

The amounts of compounds to be added relative to the iron-based soft magnetic matrix powder may be such that the resulting phosphate conversion coating have a chemical composition within the above-specified range. A phosphate-conversion-coated soft magnetic powder can be manufactured typically by preparing a phosphating solution having a solids content of from about 0.1 percent by mass to about 10 percent by mass; adding about 1 part by mass to 10 parts by mass of the phosphating solution to 100 parts by mass of an iron matrix powder; mixing them to give a mixture using a known mixer, ball mill, kneader, V-blender (twin-shell blender), or granulator; and drying the mixture at a temperature of from 150° C. to 250° C. in an air atmosphere under reduced pressure, or in a vacuum. The mixture after drying may be allowed to pass through a sieve with an opening of from about 200 μm to about 500 μm.

Silicone Resin Coating

In an embodiment, the iron-based soft magnetic powder for dust core use according to the present invention further includes a silicone resin coating on the phosphate conversion coating. This allows powdery particles to be bonded with each other firmly upon the completion of a crosslinking/curing reaction of the silicone resin (upon compression or compacting). This also contributes to the formation of highly heat-resistant Si—O bonds and thereby contributes to better thermal stability of the insulating coating.

A silicone resin, if being one undergoing slow curing, may cause the powder to be sticky and adversely affect the handleability after the coating formation. To prevent this, a silicone resin for use herein preferably has trifunctional T units ($RSiX_3$ where X represented by a hydrolyzable group) in a larger amount than that of bifunctional D units ($R_2SiX_2$ where X is as defined above). However, a silicone resin containing tetrafunctional Q units ($SiX_4$ where X is as defined above) in an excessively large amount may cause the powdery particles to be bonded excessively firmly upon precuring, and this may impede the downstream compacting process. To prevent this, the silicone resin includes T units in an amount of preferably 60 mole percent or more, more preferably 80 mole percent or more, and most preferably 100 mole percent.

As the silicone resin, a methylphenylsilicone resin in which the substituent R is methyl group or phenyl group is generally employed. It has been considered that such a methylphenylsilicone resin has a higher heat resistance with an increasing amount of phenyl group. The presence of phenyl group, however, is found to be not so effective in a heat treatment under such high-temperature conditions as employed in the present invention. This is probably because the bulkiness of the phenyl group disturbs a dense glassy network structure and contrarily reduces the thermal stability and the inhibition effect on the formation of a semiconductor compound with iron. For these reasons, the silicone resin for use herein is preferably a methylphenylsilicone resin having a methyl content of preferably 50 mole percent or more (e.g., KR255 and KR311 supplied by Shin-Etsu Chemical Co., Ltd.), more preferably one having a methyl content of 70 mole percent or more (e.g., KR300 supplied by Shin-Etsu Chemical Co., Ltd.), and most preferably a methylsilicone resin having no phenyl group (e.g., KR251, KR400, KR220L, KR242A, KR240, KR500, and KC89 supplied by Shin-Etsu Chemical Co., Ltd.; and SR2400 supplied by Dow Corning Toray Co., Ltd.). The ratio between methyl group and phenyl group in the silicone resin (coating) and the functionality thereof can be analyzed typically through FT-IR (Fourier transform infrared spectroscopy).

In a preferred embodiment, the silicone resin coating is controlled to be present in a mass of coating of from 0.05 percent by mass to 0.3 percent by mass based on the total mass (100 percent by mass) of the iron-based soft magnetic powder for dust core use, which bears the phosphate conversion coating and the silicone resin coating formed in this order. The silicone resin coating, if present in a mass of coating of less than 0.05 percent by mass, may fail to contribute to sufficient insulation and a satisfactorily high electric resistance of the iron-based soft magnetic powder for dust core use. In contrast, the silicone resin coating, if present in a mass of coating of more than 0.3 percent by mass, may often impede the densification of the powder compact.

The silicone resin coating has a thickness of preferably from 1 nm to 200 nm, and more preferably from 20 nm to 150 nm. The phosphate conversion coating and the silicone resin coating preferably have a total thickness of 250 nm or less. The two coatings, if having a total thickness of more than 250 nm, may cause the dust core to have a significantly lower magnetic flux density.

Silicone Resin Coating Formation Method

The silicone resin coating can be formed typically by dissolving a silicone resin in an alcohol organic solvent or toluene, xylene, or another petroleum organic solvent to give a silicone resin solution; mixing the silicone resin solution with an iron-based soft magnetic powder bearing a phosphate conversion coating (hereinafter also simply referred to as a "phosphate-conversion-coated iron powder") to give a mixture; and subsequently evaporating the organic solvent from the mixture.

The amount of the silicone resin relative to the phosphate-conversion-coated iron powder may be such that the resulting silicone resin coating be present in a mass of coating within the above-specified range. For example, the silicone resin coating may be formed by preparing a resin solution so as to have a solids content of from about 2 percent by mass to about 10 percent by mass; adding about 0.5 part by mass to about 10 parts by mass of the resin solution to 100 parts by mass of the phosphate-conversion-coated iron powder to give a mixture; and drying the mixture. If the resin solution is added in an amount of less than 0.5 part by mass, it might take a long time to mix the two components, or the coating might be formed ununiformly. In contrast, if the resin solution is added in an amount of more than 10 parts by mass, it might take a long time to dry the mixture, or the mixture might be dried insufficiently. The resin solution may be heated as appropriate upon mixing. The mixing apparatus as mentioned above is usable herein.

The drying is preferably performed at a temperature at which the used organic solvent evaporates and which is lower than the curing temperature of the silicone resin. This range is preferred for the organic solvent to evaporate sufficiently. When the alcohol or petroleum organic solvent is used, the drying is preferably performed at a temperature of from about 60° C. to about 80° C. The mixture after drying is preferably allowed to pass through a sieve with an opening of from about 300 μm to about 500 μm so as to remove aggregated undissolved lumps.

Precuring

The iron powder obtained after drying further bears a silicone resin coating and is to be subjected to compacting to give a powder compact. This iron powder is hereinafter also simply referred to as an "silicone-resin-coated iron powder". In a preferred embodiment, the silicone-resin-coated iron powder is heated to precure the silicone resin coating. As used herein the term "precure" or "precuring" refers to a treatment to complete the softening process of the silicone resin coating upon curing under conditions where the powdery particles remain as powdery. The precuring treatment allows the silicone-resin-coated iron powder to flow satisfactorily during warm forming (at a temperature of from about 100° C. to about 250° C.). Specifically, the silicone resin coating can be easily and conveniently precured by a technique of heating the silicone-resin-coated iron powder at a temperature around the curing temperature of the silicone resin for a short time period. However, a technique of using an agent (curing agent) is also usable. Precuring differs from curing (complete curing) in that powdery particles after precuring are not completely bonded with each other and are easily separable (crushable) from each other, whereas the resin is fully cured and the powdery particles are firmly bonded with each other after complete curing. As used herein the term "curing" or "complete curing" refers to a high-temperature heating/curing which is carried out after compacting of the powder. The complete curing allows the compact to have a higher strength.

When the silicone resin is precured and the resulting powdery particles are then separated from each other (crushed) as mentioned above, a powder having satisfactory fluidity is obtained. The resulting powder is as loose as sand and can be smoothly charged into a forming die for compacting. If precuring is not performed, the powdery particles may be bonded with each other typically upon warm forming and may be difficult to be charged into a forming die smoothly within a short time. Improvements in handleability as mentioned above are very meaningful in a real operation. In addition, it has been found that the precuring allows the resulting dust core to have an extremely higher electrical resistivity. While reasons remain unknown, this is probably because the precuring contributes to better adhesion between iron powdery particles upon curing.

The precuring, when performed by heating for a short time period, is performed preferably by heating at a temperature of from 100° C. to 200° C. for a time period of from 5 minutes to 100 minutes, and more preferably by heating at a temperature of from 130° C. to 170° C. for a time period of from 10 minutes to 30 minutes. The iron powder after precuring is also preferably allowed to pass through a sieve as described above.

Lubricant

In a preferred embodiment, the iron-based soft magnetic powder for dust core use according to the present invention further includes a lubricant. The lubricant acts to reduce the frictional drag between iron powdery particles or between the iron powder and the inner wall of the forming die upon compacting of the iron-based soft magnetic powder for dust core use. This prevents die galling of the compact or heat generation upon compacting. To exhibit such actions effectively, the lubricant is preferably contained in an amount of 0.2 percent by mass or more based on the total mass of the mixture of the iron-based soft magnetic powder for dust core use and the lubricant. However, the lubricant, if present in an excessively large amount, may impede densification of the powder compact. To prevent this, the lubricant amount is preferably controlled to 0.8 percent by mass or less. When compacting is conducted after applying a lubricant to the inner wall of a forming die (die wall lubrication process), it is acceptable to use the lubricant in an amount of less than 0.2 percent by mass.

The lubricant for use herein can be selected from among known ones, which are exemplified by powders of stearic add metal salts, such as zinc stearate, lithium stearate, and calcium stearate; polyhydroxycarboxylic add amide, ethylenebisstearylamide, (N-octadecenyphexadecanoic acid amide, and other fatty amides; paraffins; waxes; and natural or synthetic resin derivatives. Each of different lubricants may be used alone or in combination.

Compacting

The iron-based soft magnetic powder for dust core use according to the present invention is used for the manufacturing of a dust core. To manufacture a dust core, the powder is initially compacted. The compacting can be performed by any of customarily known procedures.

The compacting may be performed at a compacting pressure (surface pressure) of preferably from 490 MPa to 1960 MPa, and more preferably from 790 MPa to 1180 MPa. Compacting, particularly when performed at a compacting pressure of 980 MPa or more, can readily give a dust core having a density of 7.50 g/cm$^3$ or more, which dust core can have a high strength and good magnetic properties (magnetic flux density), thus being desirable. The compacting may be performed as either room-temperature compacting or warm compacting (from 100° C. to 250° C.). The compacting is preferably performed as warm compacting through die wall lubrication molding so as to give a high-strength dust core.

Heat Treatment

The powder compact after compacting can be subjected to a heat treatment at a high temperature because the insulating coating herein has satisfactory heat resistance. This can reduce the hysteresis loss of the dust core. The heat treatment herein may be performed at a temperature of preferably 500° C. or higher, and more preferably 550° C. or higher. This process (step) is desirably performed at a higher temperature unless the dust core have an insufficient electrical resistivity. The heat treatment temperature is preferably 700° C. or lower, and more preferably 650° C. or lower in terms of its upper limit. The heat treatment, if performed at a temperature of higher than 700° C., may cause the insulating coating to be broken.

The heat treatment may be performed in any atmosphere, but is preferably performed in an atmosphere of an inert gas such as nitrogen gas. The heat treatment may also be performed for any time period unless the duct core have an insufficient electrical resistivity, but is preferably performed for a time period of 20 minutes or longer, more preferably 30 minutes or longer, and furthermore preferably one hour or longer.

Dust Core

A dust core according to an embodiment of the present invention can be obtained by cooling the work after the heat treatment process down to room temperature.

The dust core according to the present invention is obtained through a heat treatment at a high temperature and thereby less suffers from core loss. Specifically, the dust core according to the present invention can have an electrical resistivity of 65 μΩ·m or more (preferably 100 μΩ·m or more).

EXAMPLES

The present invention will be illustrated in further detail with reference to several examples below. It should be noted, however, that the following examples are never intended to limit the scope of the present invention; and that modifications, changes, and alternations not deviating from the spirit and scope of the present invention as mentioned above and below all fall within the technical scope of the present invention. All parts and percentages are by mass, unless otherwise specified.

Test Examples 1 TO 12 and 16 to 20

Phosphate Conversion Coating Formation

A pure iron powder was used as a soft magnetic matrix powder. This was an iron-based soft magnetic matrix powder ATOMEL® ML35N supplied by Kabushiki Kaisha Kobe Seiko Sho, having an average particle size of 140 μm and aluminum and nickel contents of 0 percent by mass.

Independently, Phosphating Solutions 1 to 12, 16 to 20 (each having an aluminum content of 0 percent by mass) were prepared each as a phosphoric acid solution by mixing 50 parts of water, 35 parts of $KH_2PO_4$, 10 parts of $H_3PO_4$, and 10 parts of $(NH_2OH)_2$. $H_2PO_4$ to give Base Agent A; mixing 100 ml of Base Agent A with a nickel-containing compound (nickel pyrophosphate and/or nickel nitrate) in an amount given in Table 1 to give a mixture; and further diluting the mixture ten times with water. Test Example 1 was a sample where no nickel-containing compound was added to Base Agent A.

Table 1 below also indicates, of elements contained in Base Agent A, an element derived from an additive added for pH control (indicated as "neutralizer" in Table 1); and an element derived from an additive added as a reaction accelerator (indicated as "accelerator") in Table 1).

Table 1 also indicates a nickel ion content (in mol) in 100 ml of Base Agent A; a nickel ion content (in mop in 100 ml of the phosphating solution; and a phosphoric acid content (in mass percent) in the phosphating solution, which phosphating solution was obtained by diluting Base Agent A.

Table 1 further indicates a nickel content (in mass percent) based on the total mass (100 percent by mass) of the phosphate-conversion-coated iron powder.

To 1 kg of the pure iron matrix powder passing through a sieve with an opening of 300 μm, was added 50 ml of one of Phosphating Solutions 1 to 12 and 16 to 20 to give a mixture, the mixture was blended using a V-blender for 30 minutes or longer, dried at 200° C. in an air atmosphere for 30 minutes, and allowed to pass through a sieve with an opening of 300 μm.

Silicone Resin Coating Formation and Precuring

Next, a silicone resin "SR2400" (supplied by Dow Corning Toray Co., Ltd.) was dissolved in toluene and yielded a resin solution having a solids content of 4.8% as a silicone resin solution. The resin solution was added to the above-prepared iron powder so as to have a resin solids content of 0.1%, the resulting mixture was dried by heating in an oven furnace at 75° C. in an air atmosphere for 30 minutes, allowed to pass through a sieve with an opening of 300 μm, and precured at 150° C. for 30 minutes.

Compacting

Next, zinc stearate was dispersed as a lubricant in an alcohol to give a dispersion. After applying the lubricant dispersion to a die surface, the iron-based soft magnetic powder for dust core use was placed in the die, subjected to warm (130° C.) compacting at a compacting pressure (surface pressure) of 1176 MPa, and yielded Powder Compacts 1 to 12 and 16 to 20 of a size of 31.75 mm long by 12.7 mm wide by about 5 mm thick Heat Treatment Subsequently, Powder Compacts 1 to 12 and 16 to 19 were subjected to a heat treatment (annealing) at 600° C. in a nitrogen atmosphere for 30 minutes and yielded Dust Cores 1 to 12 and 16 to 19. Heating up to 600° C. was performed at a rate of temperature rise of about 10° C./min. Powder Compact 20 was subjected to a heat treatment at 400° C. for 120 minutes and then to annealing at 550° C. for 30 minutes, each in an air atmosphere, and yielded Dust Core 20. Heating from 400° C. up to 550° C. was performed at a rate of temperature rise of about 10° C./min.

Test Examples 13 to 15 and 21

Powder Compacts 13 to 15 and 21 were prepared by the procedure of Test Example 1, except for using one of Phosphating Solutions 13 to 15 and 21 as a phosphoric acid solution instead of Phosphating Solution 1. Phosphating Solutions 13 to 15 and 21 had an aluminum content of 0 percent by mass and were prepared by mixing 50 parts of water, 30 parts of $NaH_2PO_4$, 10 parts of $H_3PO_4$, and 10 parts of $(NH_2OH)_2.H_2SO_4$ with one another to give Base Agent B; mixing nickel pyrophosphate and/or nickel nitrate with 100 ml of Base Agent B in amounts given in Table 1; and diluting the resulting mixture ten times with water. In Test Example 13, neither nickel pyrophosphate nor nickel nitrate was mixed with Base Agent B.

Subsequently, Powder Compacts 13 to 15 were subjected to a heat treatment (annealing) at 600° C. in a nitrogen atmosphere for 30 minutes and yielded Dust Cores 13 to 15. Heating up to 600° C. was performed at a rate of temperature rise of about 10° C./min. Powder Compact 21 was subjected to a heat treatment at 400° C. for 120 minutes and then to annealing at 550° C. for 30 minutes, each in an air atmosphere, and yielded Dust Core 21. Heating from 400° C. up to 550° C. was performed at a rate of temperature rise of about 10° C./min.

Test Example 22

Powder Compact 22 was prepared by the procedure of Test Example 1, except for using Phosphating Solution 22 as a phosphoric acid solution instead of Phosphating Solution 1. The Phosphating Solution 22 had an aluminum content of 0 percent by mass and was prepared by mixing 50 parts of water, 40 parts of $H_3PO_4$, and 10 parts of $(NH_2OH)_2.H_2SO_4$ with one another to give Base Agent C; mixing nickel pyrophosphate in an amount given in Table 1 with 100 ml of Base Agent C; and diluting the resulting mixture ten times with water. Subsequently, Powder Compact 22 was subjected to a heat treatment at 400° C. for 120 minutes and then to annealing at 550° C. for 30 minutes, each in an air atmosphere, and yielded Dust Core 22. Heating from 400° C. up to 550° C. was performed at a rate of temperature rise of about 10° C./min.

Test Example 23

In 2 liters of water was dispersed 100 g of the pure iron matrix powder used in Test Example 1 to give a dispersion, and the dispersion was adjusted to have a pH of 3. The dispersion after pH control was combined with 65 ml of a 0.2 mol/L aqueous aluminum chloride solution, 65 ml of a 0.2 mol/L aqueous aluminum biphosphate solution, and nickel chloride in an amount given in Table 1 to give a mixture, and the mixture was adjusted with stirring to have a pH of 9. After stirring, the prepared iron powder was rinsed with water, filtrated, dried, and yielded a surface-treated iron powder.

Powder Compact 23 was prepared by the procedure of Test Example 1, except for using the above-prepared iron powder. Subsequently, Powder Compact 23 was subjected to a heat treatment (annealing) at 600° C. in a nitrogen atmosphere for 30 minutes and yielded Dust Core 23. Heating up to 600° C. was performed at a rate of temperature rise of about 10° C./min.

Test Examples 24 and 25

Samples containing one or more other elements than nickel in the phosphate conversion coating will be illustrated as Comparative Examples.

Powder Compacts 24 and 25 were prepared by the procedure of Test Example 1, except for using Phosphating Solutions 24 and 25 respectively as a phosphoric acid solution instead of Phosphating Solution 1. Phosphating Solutions 24 and 25 had an aluminum content of 0 percent by mass and were prepared by mixing 50 parts of water, 35 parts of $KH_2PO_4$, 10 parts of $H_3PO_4$, and 10 parts of $(NH_2OH)_2.H_2PO_4$ with one another to give Base Agent D; mixing 100 ml of Base Agent D with a Cu- or Ga-containing compound (copper nitrate or gallium phosphate) in an amount given in Table 1; and diluting the resulting mixture ten times with water. Subsequently, Powder Compacts 24 and 25 were subjected to a heat treatment (annealing) at 600° C. in a nitrogen atmosphere for 30 minutes and yielded Dust Cores 24 and 25. Heating up to 600° C. was performed at a rate of temperature rise of about 10° C./min. In Table 1, the Cu ion content in Test Example 24 was indicated in parentheses and the Ga ion content in Test Example 25 was indicated in parentheses in the Ni ion content in 100 ml of the base agent and in the Ni ion content in 100 ml of the diluted agent mixture.

The density, electrical resistivity, and transverse rupture strength of Dust Cores 1 to 25 obtained after the heat treatment were measured and indicated in Table 1. Measurements were performed by methods as follows.

Density

The dust core density was determined by actually measuring the mass and size of the dust core and calculating the density from the measured data.

Electrical Resistivity

The dust core electrical resistivity was measured with the "RM-14L" supplied by Rika Denshi Co., Ltd. as a probe and the digital multimeter "VOAC-7510" supplied by IWATSU ELECTRIC CO., LTD. as a measuring instrument according to a four-probe resistance measurement mode (four probe method). The measurement was performed at a probe-to-probe distance of 7 mm and a probe strike length of 5.9 mm, under a spring load of 10-S type with the probes being pressed onto the measurement specimen.

Transverse Rupture Strength

The dust core transverse rupture strength (bending strength) was measured to evaluate the mechanical strength. The transverse rupture strength was measured by subjecting a plate-like dust core specimen to a transverse rupture strength test. The test was performed as a three-point bending test according to JPMA M 09-1992 (method for bending strength test of sintered metal materials) prescribed by the Japan Powder Metallurgy Association. The transverse rupture strength measurement was performed with the tensile tester "AUTOGRAPH AG-5000E" (supplied by Shimadzu Corporation) at a chuck-to-chuck distance of 25 mm.

Element Amounts in Phosphate Conversion Coating

The element amounts in the phosphate conversion coating were measured by processing each sample dust core by focused ion beam machining (FIB) with the focused ion beam micromachining equipment "FB-2000A" supplied by Hitachi, Ltd.; performing elemental analysis from a cross-sectional direction of the phosphate conversion coating using a transmission electron microscope with energy dispersive x-ray analysis (TEM-EDX) (the field emission transmission electron microscope "JEM-2010F" supplied by JEOL Ltd. with an EDX analyzer supplied by Naran); measuring a phosphorus amount $M_P$ (in ma and a nickel amount $M_{Ni}$ (in mol) in the phosphate conversion coating; and determining the ratio of $M_{Ni}$ to $M_P$. In Test Example 23, the ratio of $M_{Ni}$ to $M_P$ was not measured.

Independently, an aluminum amount in the phosphate conversion coating was measured. As a result, Test Examples 1 to 22, 24, and 25 were found to contain no aluminum element in the phosphate conversion coating, whereas Test Example 23 was found to contain aluminum element in the phosphate conversion coating in an amount higher than the aluminum amount in the pure iron matrix powder.

TABLE 1

| | Iron-based soft magnetic powder for dust core use | | | | | | | | |
|---|---|---|---|---|---|---|---|---|---|
| | Base agent | | | | Amount per 100 ml of base agent | | | Ni ion content | Ni ion content (in mol) in |
| Test Example | Material composition | Neutralizer | Accelerator | Added compound | Nickel pyrophosphate (g) | Nickel nitrate (g) | Other compound (g) | (in mol) in 100 ml of base agent | 100 ml of diluted base agent |
| 1 | $KH_2PO_4$ | K | P | — | — | — | — | — | — |
| 2 | $H_3PO_4$ | | | Nickel pyro- | 2 | — | — | 0.0100 | 0.00100 |

TABLE 1-continued

| | | | | | | | | | |
|---|---|---|---|---|---|---|---|---|---|
| 3 | $(NH_2OH)_2 \bullet H_2PO_4$ | | | phosphate | 8 | — | — | 0.0400 | 0.00400 |
| 4 | | | | Nickel nitrate | — | 2 | — | 0.0069 | 0.00069 |
| 5 | | | | | — | 4 | — | 0.0138 | 0.00138 |
| 6 | | | | | — | 8 | — | 0.0276 | 0.00276 |
| 7 | | | | | — | 12 | — | 0.0414 | 0.00414 |
| 8 | | | | | — | 16 | — | 0.0552 | 0.00552 |
| 9 | | | | Nickel pyro- | 2 | 8 | — | 0.0376 | 0.00376 |
| 10 | | | | phosphate and | 8 | 8 | — | 0.0676 | 0.00676 |
| 11 | | | | nickel nitrate | 12 | 4 | — | 0.0738 | 0.00738 |
| 12 | | | | | 12 | 8 | — | 0.0876 | 0.00876 |
| 13 | $NaH_2PO_4$ | Na | S | — | — | — | — | — | — |
| 14 | $H_3PO_4$ | | | Nickel nitrate | — | 4 | — | 0.0138 | 0.00138 |
| 15 | $(NH_2OH)_2 \bullet H_2SO_4$ | | | Nickel pyro-phosphate and nickel nitrate | 12 | 8 | — | 0.0876 | 0.00876 |
| 16 | $KH_2PO_4$ | K | P | Nickel nitrate | — | 1 | — | 0.0035 | 0.00035 |
| 17 | $H_3PO_4$ $(NH_2OH)_2 \bullet H_2PO_4$ | | | Nickel pyro-phosphate | 1 | — | — | 0.0050 | 0.00050 |
| 18 | | | | Nickel pyro-phosphate and nickel nitrate | 10 | 23 | — | 0.1300 | 0.01300 |
| 19 | | | | Nickel pyro-phosphate and nickel nitrate | 10 | 38 | — | 0.1800 | 0.01800 |
| 20 | | | | Nickel pyro-phosphate | 6 | — | — | 0.0300 | 0.00300 |
| 21 | $NaH_2PO_4$ $H_3PO_4$ $(NH_2OH)_2 \bullet H_2SO_4$ | Na | S | Nickel pyro-phosphate | 6 | — | — | 0.0300 | 0.00300 |
| 22 | $H_3PO_4$ $(NH_2OH)_2 \bullet H_2SO_4$ | — | S | Nickel pyro-phosphate | 6 | — | — | 0.0300 | 0.00300 |
| 23 | $AlCl_3$ $Al(H_2PO_4)_3$ | — | — | Nickel chloride | — | — | 7 | 0.0025 | — |
| 24 | $KH_2PO_4$ | K | P | Copper nitrate | — | — | 12 | (0.0500) | (0.005) |
| 25 | $H_3PO_4$ $(NH_2OH)_2 \bullet H_2PO_4$ | | | Gallium phosphate | — | | 2 | (0.0100) | (0.001) |

| | Iron-based soft magnetic powder for dust core use | | | | | | |
|---|---|---|---|---|---|---|---|
| | | | Phosphate-conversion-coated iron powder | | | | |
| | | | | | Dust core | | |
| Test Example | "Phosphoric acid content (in mass percent) in diluted base agent" | Ni content (in mass percent) based on total mass of iron powder | Ni amount (in mol) in 100 g of iron powder | Density ($g/cm^3$) | Electrical resistivity ($\mu\Omega \cdot m$) | Transverse rupture strength (MPa) | MNi/Mp |
| 1 | 3.0 | 0 | 0 | 7.69 | 58 | 114 | — |
| 2 | 3.0 | 0.0029 | 0.000050 | 7.71 | 87 | 118 | <0.1 |
| 3 | 3.1 | 0.0117 | 0.000200 | 7.69 | 102 | 117 | 0.1 |
| 4 | 3.0 | 0.0021 | 0.000035 | 7.71 | 78 | 111 | <0.1 |
| 5 | 3.0 | 0.0041 | 0.000069 | 7.69 | 99 | 111 | <0.1 |
| 6 | 3.0 | 0.0081 | 0.000138 | 7.71 | 91 | 110 | <0.1 |
| 7 | 3.0 | 0.0122 | 0.000207 | 7.70 | 104 | 113 | 0.1 |
| 8 | 3.0 | 0.0162 | 0.000276 | 7.69 | 108 | 122 | 0.1 |
| 9 | 3.0 | 0.0110 | 0.000188 | 7.71 | 93 | 109 | <0.1 |
| 10 | 3.1 | 0.0198 | 0.000338 | 7.71 | 121 | 119 | 0.2 |
| 11 | 3.1 | 0.0217 | 0.000369 | 7.69 | 112 | 116 | 0.1 |
| 12 | 3.1 | 0.0257 | 0.000438 | 7.69 | 112 | 119 | 0.1 |
| 13 | 3.0 | 0 | 0 | 7.70 | 61 | 111 | — |
| 14 | 3.0 | 0.0041 | 0.000069 | 7.70 | 108 | 112 | 0.1 |
| 15 | 3.1 | 0.0257 | 0.000438 | 7.69 | 129 | 105 | 0.2 |
| 16 | 3.0 | 0.00103 | 0.000018 | 7.69 | 66 | 111 | <0.1 |
| 17 | 3.0 | 0.00147 | 0.000025 | 7.70 | 72 | 112 | <0.1 |
| 18 | 3.1 | 0.03830 | 0.000650 | 7.61 | 128 | 103 | 0.4 |
| 19 | 3.1 | 0.05371 | 0.000900 | 7.60 | 129 | 97 | 0.6 |
| 20 | 3.0 | 0.00882 | 0.000150 | 7.69 | 102 | 117 | 0.1 |
| 21 | 3.0 | 0.00882 | 0.000150 | 7.69 | 101 | 107 | 0.1 |
| 22 | 3.0 | 0.00882 | 0.000150 | 7.70 | 101 | 103 | 0.1 |
| 23 | — | 0.00010 | 0.000270 | 7.60 | 60 | 78 | ※ |
| 24 | 3.0 | 0 | 0 | 7.69 | 63 | 108 | — |
| 25 | 3.0 | 0 | 0 | 7.70 | 56 | 103 | |

※ Not measured

A comparison between Test Examples 18 and 19 indicates that, when a sample had an excessively high nickel ion content in 100 ml of the phosphating solution (Test Example 19), the resulting phosphate conversion coating contained nickel in a large amount with respect to that of phosphorus, and this cause the dust core to have a lower density and a lower transverse rupture strength.

A comparison among Test Examples 20 to 22 demonstrates that, when samples each having the same Ni amount in the phosphate conversion coating, the resulting dust cores have an electrical resistivity at same level, but the dust core according to Test Example 20 containing potassium (K) element in the phosphate conversion coating had a transverse rupture strength higher than those of the dust cores according to Test Examples 21 and 22 containing no potassium element in the phosphate conversion coating.

Test Example 23 contained aluminum element as another element than Ni in the phosphate conversion coating in an amount larger than the aluminum amount in the pure iron matrix powder, and the resulting dust core had an electrical resistivity not improved and had a low transverse rupture strength.

Test Examples 24 and 25 contained Cu and Ga, respectively, as another element than Ni in the phosphate conversion coating. The data on these samples demonstrate that the presence of Cu or Ga in the phosphate conversion coating failed to contribute to a higher electrical resistivity.

Table 1 indicates the amount (in mole) of Ni in 100 g of the phosphate-conversion-coated iron powder.

FIG. 1 illustrates how the dust core electrical resistivity varies depending on the amount (in mol) of Ni in 100 g of the iron powder. Only data of Test Examples 1 to 22 as given in Table 1 were plotted in FIG. 1.

FIG. 1 demonstrates that there is a correlation between the amount of nickel element to be added to the phosphate conversion coating and the electrical resistivity of the resulting dust core.

Referential Example

Figure 2:
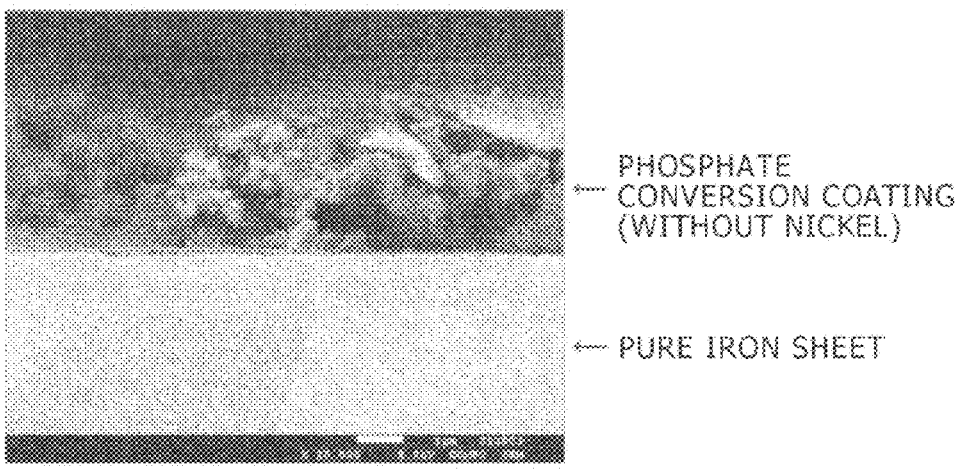
FIG. 2 depicts a scanning electron microscope image (SEM image) of a phosphate conversion coating containing substantially no nickel element.
Figure 3:
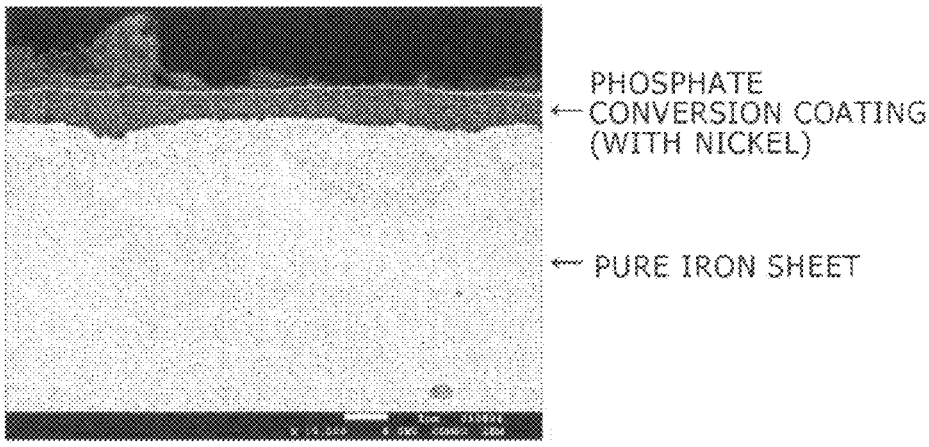
FIG. 3 depicts a scanning electron microscope image (SEM image) of a phosphate conversion coating containing nickel element.

A pure iron sheet 150 mm long by 150 mm wide by 0.5 mm thick was purchased from The Nilaco Corporation and cut into a piece 50 mm long by 50 mm wide using a shear cutter. Each one side was polished with a #1000 paper, treated with acetone to remove oils, and subjected to alkaline degreasing. Independently, there were prepared a phosphating solution (phosphoric acid concentration: 1.5%) by diluting Base Agent A as intact twenty times with water; and a phosphating solution (phosphoric acid concentration: 1.6%) by adding 12 g of nickel phosphate and 8 g of nickel nitrate to 100 ml of Base Agent A to give a mixture, and diluting the mixture twenty times with water. The pure iron sheet was immersed in each of the phosphoric acid solutions, raised from the solution immediately thereafter, held in a thermo-hygrostat (20° C., 95%) for 30 minutes, heated at 210° C. in an air atmosphere for 30 minutes, and yielded samples. The cross section of each sample was observed under a scanning electron microscope (SEM) to observe how the coating was formed. The phosphating solution containing no nickel gave a coating having a nonuniform thickness due to generation of sludge (FIG. 2). By contrast, the phosphating solution further containing nickel gave a coating having a uniform thickness (FIG. 3).

While the present invention has been described in detail with reference to preferred embodiments thereof with a certain degree of particularity, it will be understood by those skilled in the art that various changes and modifications are possible without departing from the spirit and scope of the invention.

The present application is based on Japanese Patent Application No. 2011-135670 filed on Jun. 17, 2011 and Japanese Patent Application No. 2012-057933 filed on Mar. 14, 2012, the entire contents of which are incorporated herein by reference.

INDUSTRIAL APPLICABILITY

The present invention enables manufacturing of dust cores which have satisfactory mechanical strengths. The dust cores are useful as cores for rotors and stators of motors.

The invention claimed is:

1. An iron-based soft magnetic powder, comprising:

an iron-based soft magnetic matrix powder; and a phosphate conversion coating present on a surface of the iron-based soft magnetic matrix powder, wherein the phosphate conversion coating comprises nickel in a content of from 0.001 percent by mass to 0.05 percent by mass, based on a total amount of the iron-based soft magnetic powder, and the phosphate conversion coating comprises aluminum in a content of equal to or less than an aluminum content in the iron-based soft magnetic matrix powder.

2. The iron-based soft magnetic powder according to claim 1, wherein the phosphate conversion coating comprises substantially no aluminum.

3. The iron-based soft magnetic powder according to claim 1, wherein a molar ratio of nickel in the phosphate conversion coating to phosphorus in the phosphate conversion coating $M_{Ni}/M_P$ is from 0.1 to 0.5.

4. The iron-based soft magnetic powder according to claim 1, wherein the phosphate conversion coating further comprises potassium.

5. The iron-based soft magnetic powder according to claim 1, further comprising a silicone resin coating present on the phosphate conversion coating.

6. A method for manufacturing an iron-based soft magnetic powder, the method comprising:

mixing an iron-based soft magnetic matrix powder with a phosphoric acid solution comprising substantially no aluminum to give a first mixture, where the phosphoric acid solution is prepared by dissolving a nickel-containing compound and phosphoric acid in water and has a nickel ion content of from 0.003 to 0.015 mol per 100 ml of the phosphoric acid solution; and evaporating water from the first mixture to give a phosphate-conversion-coated iron powder comprising the iron-based soft magnetic matrix powder and, formed on a surface thereof, a phosphate conversion coating.

7. The method according to claim 6, further comprising: after the evaporating, mixing the phosphate-conversion-coated iron powder with a silicone resin solution to give a second mixture, where the silicone resin solution is prepared by dissolving a silicone resin in an organic solvent;

evaporating the organic solvent from the second mixture to give a silicone-resin-coated iron powder further comprising a silicone resin coating on the phosphate conversion coating; and heating the silicone-resin-coated iron powder to precure the silicone resin coating, in this order.

8. The method according to claim 6, wherein the nickel-containing compound comprises at least one of nickel pyrophosphate and nickel nitrate.

9. The method according to claim 6, wherein the phosphoric acid solution comprises no aluminum.

10. The method according to claim 6, wherein the phosphoric acid solution further comprises potassium, and the phosphoric acid solution comprises no aluminum.

11. A dust core, obtained by a process comprising:

compacting an iron-based soft magnetic powder manufactured by the method according to claim 6 to give a powder compact; and subjecting the powder compact to a heat treatment at a temperature of 500° C. or higher.

12. The iron-based soft magnetic powder according to claim 1, wherein the phosphate conversion coating further comprises at least one of sodium, nitrogen, sulfur, and chlorine.

13. The iron-based soft magnetic powder according to claim 1, wherein the phosphate conversion coating has a thickness of from 1 nm to 250 nm.

14. The iron-based soft magnetic powder according to claim 1, further comprising a lubricant.

15. The iron-based soft magnetic powder according to claim 5, wherein the silicon resin comprises trifunctional T units in a larger amount than bifunctional D units.

16. The iron-based soft magnetic powder according to claim 5, wherein a content of the silicon resin coating is from 0.05 percent by mass to 0.3 percent by mass, based on a total mass of the iron-based soft magnetic powder.

17. The iron-based soft magnetic powder according to claim 5, wherein the silicon resin coating has a thickness of from 1 nm to 200 nm.

18. The iron-based soft magnetic powder according to claim 5, wherein a total thickness of the phosphate conversion coating and the silicon resin coating is 250 nm or less.

* * * * *